United States Patent [19]

Breckner

[11] Patent Number: 4,798,531

[45] Date of Patent: Jan. 17, 1989

[54] PROCESS AND APPARATUS FOR THE CONTROL OF THE AIR AND FUEL SUPPLY TO A PLURALITY OF BURNERS

[75] Inventor: Kurt Breckner, Waiblingen, Fed. Rep. of Germany

[73] Assignee: Eckardt AG, Stuttgart, Fed. Rep. of Germany

[21] Appl. No.: 78,809

[22] Filed: Jul. 28, 1987

[30] Foreign Application Priority Data

Nov. 11, 1986 [DE] Fed. Rep. of Germany ..... 3638410

[51] Int. Cl.[4] ..... F23N 1/02

[52] U.S. Cl. ..... 431/12; 431/42; 431/48; 431/90; 236/15 BD

[58] Field of Search ..... 431/12, 38, 39, 42, 431/63, 89, 90, 48; 236/15 BD

[56] References Cited

U.S. PATENT DOCUMENTS

| | | | |
|---|---|---|---|
| 4,043,742 | 8/1977 | Egar et al. | 431/12 |
| 4,065,250 | 12/1977 | Schlieler et al. | 431/90 |
| 4,125,093 | 11/1978 | Platzer, Jr. | 431/90 |
| 4,348,169 | 9/1982 | Swittenbank et al. | 431/89 |
| 4,363,440 | 12/1982 | Broach | 431/12 |
| 4,425,930 | 1/1984 | Kruto | 431/12 |
| 4,493,635 | 1/1985 | Ito et al. | 431/90 |
| 4,498,863 | 2/1985 | Hanson et al. | 431/89 |

FOREIGN PATENT DOCUMENTS 1526265 1/1970 Fed. Rep. of Germany .

*Primary Examiner*—Margaret A. Focarino

*Attorney, Agent, or Firm*—Burns, Doane, Swecker & Mathis

[57] ABSTRACT

A plurality of burners, e.g., steam boiler burners, are provided with air and fuel through separate conduits. A separate air volume regulator is provided for each burner, but only a single fuel volume regulator is provided for all burners. After one burner has been ignited, a signal representative of the air volume associated therewith is supplied to an additional burner, whereby substantially the same volume of air is supplied to the additional burner. To ignite the additional burner, it is then only necessary to double the volume of fuel being supplied, and divide that fuel volume equally among the burners.

2 Claims, 1 Drawing Sheet

PROCESS AND APPARATUS FOR THE CONTROL OF THE AIR AND FUEL SUPPLY TO A PLURALITY OF BURNERS

BACKGROUND AND OBJECTS OF THE INVENTION

The invention concerns a process and an apparatus to carry out the process for the control of the air and fuel supply to a plurality of burners. The burners are fed air and fuel by means of adjustable volume control elements. For the ignition of a first burner, a predetermined volume of air and fuel is supplied to the first burner. Following the ignition of a burner, this burner is fed a volume of air adapted to the volume of fuel supplied.

It is known to heat, for example, a steam boiler by means of a plurality of burners. For each of these burners, the air introduced is controlled in a certain proportion relative to the fuel supplied. For this purpose, volume control elements are used, which volume control elements are actuated by a control unit. To ignite a first burner, and also to ignite additional burners, a predetermined volume of air and a predetermined quantity of fuel are supplied to the burners. It is thus necessary to provide each burner with volume control elements for the supply of both air and fuel, each volume control element operated by an actuating device. This arrangement is expensive.

It is an object of the invention to provide a simplified and less expensive control process and apparatus which provides a reliable ignition and safe operation of the burners.

SUMMARY OF THE INVENTION

This object is attained in accordance with the present invention wherein the ignition of an additional burner is achieved by supplying the latter with substantially the same air and fuel volumes fed to a burner(s) which is already ignited. It is possible in this manner to supply all of the burners with fuel by means of a common actuating device and a common fuel volume control element. As a result, the system is less complex and less expensive.

The burners are connected by means of fuel lines to a fuel supply unit and may be charged with air by means of air lines and adjustable control valves. Sensors are provided to measure the volumes of air and fuel supplied to the burners, together with a master control unit to regulate the control valves as a function of the air and fuel volumes measured. A single fuel volume regulator regulates the supply of fuel to all of the burners. An on-off valve is present in each fuel conduit and is actuated by the master control unit.

In this apparatus the fuel volume fed to the burners is regulated by the control valve and distributed by the on-off valves. An actuating device actuates the control valve.

Preferably, a maximum signal selector is connected with the sensors which measure the volume of air supplied to already-ignited burners and serves to adjust the air volume conducted to a burner to be ignited. The value of the volume of air to be supplied to a burner to be ignited is determined by the highest signal received by the maximum signal selector.

Preferably, at least one comparator is provided to compare the volume of air intended to be supplied to a burner to be ignited with the actual air volume being supplied. The control valve determining the volume of fuel and the on-off valve associated with the burner to be ignited is regulated in accordance with the comparison made, in order to assure that the burner to be ignited receives fuel only if a corresponding volume of air is also being supplied.

Preferably, the control system regulates the fuel volume supplied to the burners in a step-wise manner as a function of the number of burners ignited. Thus, for every additional burner ignited, the volume of fuel supplied to the burners is increased by an equal increment.

BRIEF DESCRIPTION OF THE DRAWINGS

The objects and advantages of the invention will become apparent from the following detailed description of preferred embodiments thereof in connection with the accompanying drawings, in which like numerals designate like elements, and in which.

DETAILED DESCRIPTION OF PREFERRED EMBODIMENTS OF THE INVENTION

Figures 1, 2:
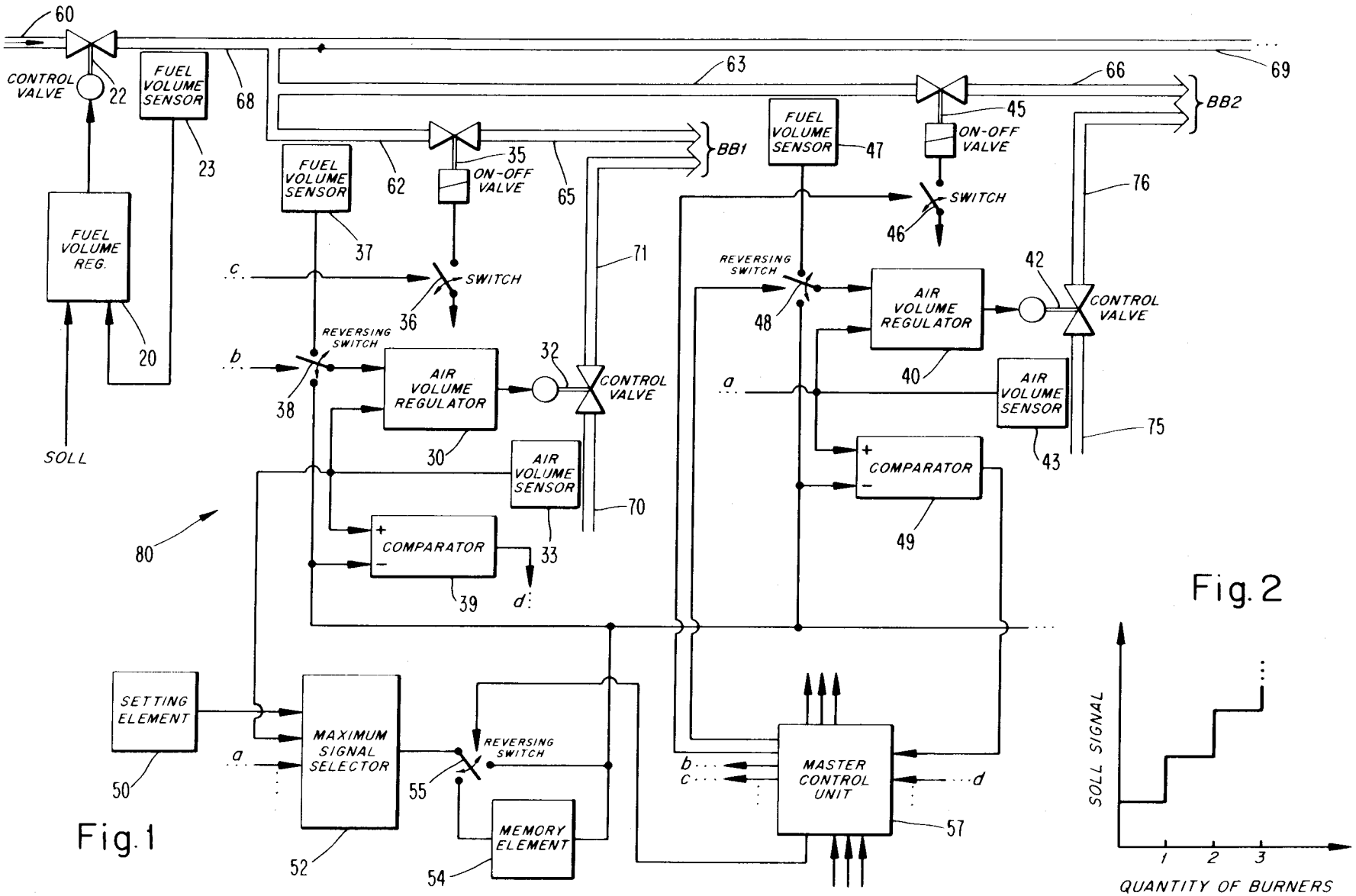
FIG. 1 depicts a schematic block circuit diagram of an apparatus to control the supply of air and fuel to a plurality of burners.
FIG. 2 is a diagram visualizing the relationship between the number of burners ignited and the volume of fuel supplied to the burners.

As depicted in the block circuit diagram of FIG. 1, an output signal of a fuel volume regulator 20 operates a control valve 22 which is connected by means of a fuel line 60 to a fuel supply device (not shown). A fuel volume sensor 23 is integrated into a fuel line 68, which is connected to the output side of the control valve 22. The fuel volume sensor 23 produces an output signal corresponding to the volume of fuel flowing through the fuel line 68, which signal is delivered to the fuel volume regulator 20 by means of a conduit. As a further inlet signal, the fuel volume regulator 20 is supplied with a set signal SOLL corresponding to the desired volume of fuel to be conducted through the fuel line 68.

Downstream of the fuel volume sensor 23, the fuel line 68 divides into first, second, and third fuel lines 62, 63, 69. In the fuel line 62, a fuel volume sensor 37 is provided, the output signal of which is conducted to a reversing switch 38. Downstream of the fuel volume sensor 37, an on-off valve 35 is provided which is connected with the first fuel line 62. A fuel line 65 conducts fuel from the outlet of the valve 35 to a first burner BB1. The on-off valve 35 is connected with a switch 36, controlled by means of a master control unit 57 via a conduit c.

An air volume regulator 30 provides an output signal 32 which acts on a control valve 32 disposed in air-carrying lines 70, 71. An air volume sensor 33 is integrated in the air-carrying line 70, while the line 71 supplies air to the first burner BB1. The air volume sensor 33 produces an output signal corresponding to the volume of air supplied to the first burner, and that signal is delivered to the air volume regulator 30, as well as to a comparator 39 and a maximum signal selector 52. The air volume regulator 30 is further connected with a common connecting point of the reversing switch 38, the switch 38 being operated by the master control unit 57 via link b.

The second connecting point of the reversing switch 38 is connected on the one hand to the comparator 39 and on the other hand, to a memory element 54 and an additional reversing switch 55. The common connecting point of the reversing switch 55 is connected to the maximum signal selector 52. The second connecting point of the reversing switch 55 is connected to the inlet of the memory element 54. The reversing switch 55 is operated by a signal received from the master control unit 57.

A further input signal is supplied to the maximum signal selector 52 from a setting element 50, by which a given air volume value may be set by an operator for the ignition of a burner. The outlet of the comparator 39 is connected via a line d to the memory part 54.

In a manner similar to the first fuel line 72, the second fuel line 63 is provided with an on-off switch 45 and a fuel volume sensor 47. By means of a fuel line 66, fuel is supplied to a second burner BB2. Similarly to the first burner, an air volume regulator 40 is provided for the second burner, which regulator 40 is connected to a control valve 42 to regulate the volume of air supplied to the second burner via lines 75, 76. An air volume sensor 43 is connected with the line 75, with the output signal of that sensor being conducted, in a manner corresponding to the first burner, to a comparator 49, the air volume regulator 40 and the maximum signal selector 52 via a line a. The fuel volume sensor 47 and the on-off valve 45 are connected, as in the case of the first burner, with a switch 46 and a reversing switch 48, both controlled by the master control unit 57. The output signal of the comparator 49 is conducted to the master control unit 57.

An additional burner (not shown) may be connected by means of the fuel line 69, which burner is equipped in a manner similar to the afore-described first and second burners, with valves, sensors, etc., and connected with the maximum signal selector 52, the memory element 54 and the master control unit 57. It is further possible to apply to the master control unit 57 additional signals, for example, input signals regulated by an operator.

The fuel volume regulator 20, the air volume regulator 30, 40, the comparators 39, 49, the maximum signal selector 52, the memory element 54, the master control unit 57, the switches 36, 46 and the reversing switches 38, 48, 55 together form a control system 80 for the control valves 22, 32, 42 and the on-off valves 35, 45. The control system 80 may comprise, for example, an electronic computer.

IN OPERATION, if the burners are inactive, the on-off valves 35, 45 are closed, so that no fuel is being fed to the burners. Similarly, no air or only a slight volume of air is being supplied to the burners.

In order to ignite, for example, the first burner BB1, the master control unit 57 actuates the switch 38, thereby connecting the air volume regulator 30 with the maximum selection element 52 via the reversing switch 55. Because of the slight volume of air supplied to the burners, the output signal produced by the setting element 50 is the largest of the signals received by the maximum signal selector 52. This signal, transmitted by the setting element 50, is applied to the air volume regulator 30. The latter sets, by means of a set value/actual value comparison, the control valve 32 and thus sets the air volume to be supplied to the first burner in keeping with the value from the setting element 50.

When the control valve 32 attains its position determined by the setting element 50, this fact is detected by the comparator 39 and communicated to the master control unit 57 via line d.

The master control unit 57 then reverses the reversing switch 55 so that the output signal of the maximum signal selector 52 is stored by the memory element 54, thereby holding the input signal of the comparator 39 and the air volume regulator 30 constant. Subsequently, the master control unit 57 provides the fuel volume regulator 20 with a set value SOLL corresponding to the volume of fuel required for the operation of one burner. The fuel volume regulator 20 adjusts the control valve 22 in accordance with a set value/actual value comparison. Finally, the master control unit 57 opens the on-off valve 35 by closing the switch 37, so that fuel is supplied to the first burner.

The volume of air which has been fed to the first burner has been determined so as to be properly matched to the volume of fuel supplied to the burner, so that a reliable ignition of the burner is assured.

Following the ignition of the first burner, the reversing switch 38 is returned into its operating position, whereby the fuel volume sensor 37 is connected to the air volume regulator 30. Thus, the volume of air supplied to the burner is adjusted by means of the air volume regulator 30 in accordance with the fuel volume actually being introduced.

To ignite the second burner, the air volume regulator 40 is connected via the reversing switches 48 and 55, with the maximum signal selector 52. The latter transmits through its outlet the largest signal received at its inlets, viz., the signal from the air volume sensor 33. The air volume regulator 40 sets the control valve 42 to the value determined by the maximum signal selector 52 by means of a set value/actual value comparison.

The comparator 49 detects the agreement of the set value with the actual value and transmits it to the master control unit 57. The latter increases, by way of the set value signal SOLL, the fuel volume supplied to the burners and opens the on-off valve 45 via the switch 46. To operate the second burner, the fuel volume fed to the first burner is doubled, as indicated in FIG. 2. For the operation of additional burners, the fuel volume supplied to the burners is always increased by the increment required to operate a burner. In FIG. 2 the quantity of the burners ignited is plotted on the abscissa, and the set value SOLL (and thus the fuel volume fed to the burners) is plotted on the ordinate.

To ignite the second burner, therefore, twice the volume supplied to the first burner is introduced. This is distributed equally to the two burners so that the fuel volumes supplied to the two burners are substantially equal. The air volume supplied to the second burner also corresponds substantially to the volume conducted to the first burner. This is obtained by means of the maximum signal selector 52, which transmits the value of the largest volume of air required for the operation of a burner, which valve serves as a set value establishing the ignition air volume of the second burner.

Following the ignition of the second burner, the reversing switch 48 is reversed and the air volume conducted to the second burner is adjusted by the air volume regulator 40 as a function of the fuel volume actually being introduced. Following the ignition of the second burner, the reversing switch 55 is actuated to connect the maximum signal selector with the memory element to avoid undesirable set value fluctuations during the ignition process.

In the process according to the invention, therefore, for the ignition of a first burner is accomplished by supplying a predetermined air volume and a predetermined fuel volume to the first burner. After the ignition of that burner, the air volume is controlled as a function of the fuel volume actually being supplied. To ignite a second burner, the volume of air supplied to it is determined in accordance with the volume of air supplied to the already ignited first burner. The fuel volume is increased in equal increments, so that the fuel volume fed to the burners is directly related to the number of burners ignited. The fuel volume introduced is divided uniformly over the burners ignited, so that they are always supplied with the same quantity of fuel. The air volume fed to each burner is controlled by an air volume regulator associated with it. The fuel volume supplied to all of the burners is controlled by means of a single fuel volume regulator. An on-off valve is associated with each of the burners.

It will be appreciated that the present invention provides a relatively simple and less expensive system for supplying air and fuel to a plurality of burners. For example, the need for only a single adjustable fuel volume regulator for all burners significantly reduces overall costs of the system.

The air volume regulators and the fuel volume regulator preferably comprise PI (proportional integral) controllers of a known type. As the control valves, for example, valves coupled with an electric motor may be used, the flow rate of which may be controlled by actuating the motor. Magnetically actuated valves may be employed, for example, as the on-off valves, which are either fully open or closed. The relationship shown in FIG. 2 between the number of the burners ignited and the fuel volume supplied to them may be stored in the master control unit in such manner that the master control unit sends corresponding signals SOLL to the fuel volume regulator. It is also possible to provide measuring devices other than the air volume sensors and fuel volume sensors described, with such devices detecting, for example, the mass of the air or the fuel. It is further possible to relate the measured values to certain time units.

The process according to the invention and described above may be used, for example, to heat a steam boiler by means of a plurality of burners. It is understood that the process may also be used in other fields of application.

Although the present invention has been described in connection with preferred embodiments thereof, it will be appreciated by those skilled in the art that additions, modifications, substitutions, and deletions not specifically described, may be made without departing from the spirit and scope of the invention as defined in the appended claims.

What I claim is:

1. A process for controlling the supply of air and fuel to at least three burners, comprising the steps of:

(A) providing separate fuel lines for said burners and a common fuel supply conduit means which supplies fuel to all of said fuel lines, the volume of fuel supplied through said common fuel supply conduit means being regulated by a fuel volume regulator, (B) providing separate air-carrying lines for said burners, the volume of air supplied through said air-carrying lines being regulated by respective adjustable air volume regulators for said air-carrying lines, (C) supplying a predetermined volume of fuel and a predetermined volume of air to a first of said burners through a first fuel line and a first air-carrying line, respectively, said fuel volume being regulated by said adjustable fuel volume regulator, and said air volume being regulated by a first of said adjustable air volume regulators, with remaining ones of said fuel lines being kept closed, (D) thereafter providing a signal to said first adjustable air volume regulator in accordance with the actual volume of fuel supplied to said first burner to accordingly adjust the volume of air supplied to said first burner, (E) thereafter providing a signal to a second of said adjustable air volume regulators in accordance with the adjusted volume of air supplied to said first burner to supply to a second of said burners a volume of air substantially the same as the volume of air being supplied to said first burner, (F) thereafter opening a second of said fuel lines for said second burner and actuating said fuel volume regulator to conduct double said predetermined volume of fuel through said fuel supply conduit means, whereby said predetermined volume of fuel is supplied to each of said first and second burners, with remaining ones of said fuel lines other than said first and second fuel lines being kept closed, (G) thereafter providing a signal to said second adjustable air volume regulator in accordance with the actual volume of fuel supplied to said second burner to accordingly adjust the volume of air supplied to said second burner, (H) thereafter providing a signal to at least one additional adjustable air volume regulator in accordance with the largest of said adjusted volumes of air supplied to said already-ignited burners to supply to an additional one of said burners a volume of air substantially the same as said largest volume, (I) thereafter opening said fuel line for said additional burner and actuating said fuel volume regulator to supply triple said predetermined volume of fuel through said fuel supply conduit means, whereby said predetermined volume of fuel is supplied to each of said first, second, and additional burners, and (J) thereafter providing a signal to said additional adjustable air volume regulator in accordance with the actual volume of fuel supplied to said additional burner to accordingly adjust the volume of air supplied to said additional burner.

2. Apparatus for controlling the supply of air and fuel to at least first, second, and third burners, comprising:

a common fuel supply conduit means, first, second, and third fuel lines connected in parallel with said common fuel supply conduit means and communicating with said first, second and third burners, respectively, first, second, and third on-off valves disposed in respective ones of said first, second, and third fuel lines and movable between a fully open position and a fully closed position, a fuel volume regulator disposed in said common fuel supply conduit mean upstream of said fuel lines for adjusting the volume of fuel supplied through said common fuel supply conduit means in whole number multiples of a predetermined volume, such that said predetermined volume is supplied when only said first valve is open, twice said predetermined volume is supplied when only said first and second valves are open, and thrice said predetermined value is supplied when said first, second, and third valves are open, first, second, and third air-carrying lines communicating with respective ones of said burners, first, second, and third adjustable air volume regulators connected with respective ones of said air-carrying lines for regulating the volume of air supplied therethrough, and means for providing a signal to said second adjustable air volume regulator in accordance with the volume of air supplied to said first burner to supply to said second burner a volume of air substantially the same as the volume of air supplied to said first burner, and for providing a signal to said third adjustable air volume regulator in accordance with the largest of said adjusted volumes of air supplied to said first and second burners to supply to said third burner a volume of air substantially the same as said largest volume.

* * * * *